US010071833B2

(12) United States Patent
Haedt et al.

(10) Patent No.: US 10,071,833 B2
(45) Date of Patent: Sep. 11, 2018

(54) TEAR-OPEN POUCH FOR FRAGILE THIN MATERIALS

(71) Applicant: BEMIS COMPANY, INC., Neenah, WI (US)

(72) Inventors: Edward L. Haedt, Oshkosh, WI (US); Lyndsey A. McMillan, Neenah, WI (US); Lindsay A. Kellermann, Neenah, WI (US)

(73) Assignee: Bemis Company, Inc., Neenah, WI (US)

( * ) Notice: Subject to any disclaimer, the term of this patent is extended or adjusted under 35 U.S.C. 154(b) by 0 days.

(21) Appl. No.: 14/760,244

(22) PCT Filed: Jan. 18, 2013

(86) PCT No.: PCT/US2013/022101
§ 371 (c)(1),
(2) Date: Jul. 10, 2015

(87) PCT Pub. No.: WO2014/113016
PCT Pub. Date: Jul. 24, 2014

(65) Prior Publication Data

US 2015/0353237 A1 Dec. 10, 2015

(51) Int. Cl.
*B65D 33/00* (2006.01)
*B65D 27/34* (2006.01)
*B65D 75/58* (2006.01)

(52) U.S. Cl.
CPC ..... *B65D 27/34* (2013.01); *B65D 75/5805* (2013.01); *B65D 75/5827* (2013.01); *B65D 75/5833* (2013.01)

(58) Field of Classification Search
CPC ..... B65D 75/30; B65D 75/5855; B65D 75/5805; B65D 2215/04; B65D 75/5833; B65D 27/34
(Continued)

(56) References Cited

U.S. PATENT DOCUMENTS 2,923,404 A 2/1960 Adell
3,809,220 A * 5/1974 Arcudi ..... B65D 75/5888 206/484
(Continued)

FOREIGN PATENT DOCUMENTS

CN 102143898 A 8/2011
EP 1769908 A1 4/2007
(Continued)

OTHER PUBLICATIONS

Machine translation of JP 2011073727 A (Kokuryo).*
(Continued)

*Primary Examiner* — Jes F Pascua
(74) *Attorney, Agent, or Firm* — Lynn M. Nett

(57) ABSTRACT

Tear-open pouches having a first panel and a second panel sealed to one another at a non-peelable or peelable perimeter seal defining a compartment having a first compartment area of the first panel and a second compartment area of the second panel with a score disposed on the first panel extending from a first position in the perimeter seal along a first direction that extends across the first panel and into the first compartment area. An optional second score can be disposed on the first or second panel and extend from a second position in the perimeter seal along a second direction that extends across the first or second panel and into the first or second compartment area and the second position can be adjacent to the first position, and the first and second directions can be divergent to one another.

7 Claims, 6 Drawing Sheets

(58) Field of Classification Search
USPC ..... 383/200, 207, 210, 113; 206/532
See application file for complete search history.

(56) References Cited

U.S. PATENT DOCUMENTS

| | | | | |
|---|---|---|---|---|
| 3,939,969 | A * | 2/1976 | Miller | A61B 17/06138 206/476 |
| 3,955,001 | A | 5/1976 | Kuepach et al. | |
| 4,249,656 | A * | 2/1981 | Cerwin | A61B 17/06138 206/380 |
| 4,253,563 | A * | 3/1981 | Komarnycky | A61B 17/06138 206/476 |
| 4,797,309 | A | 1/1989 | Kammerer et al. | |
| 4,881,649 | A | 11/1989 | Hsu et al. | |
| 4,977,807 | A | 12/1990 | Kai et al. | |
| 5,222,813 | A | 6/1993 | Kopp et al. | |
| 5,229,180 | A | 7/1993 | Littmann | |
| 5,371,997 | A | 12/1994 | Kopp et al. | |
| 5,472,093 | A | 12/1995 | Nugent et al. | |
| 5,511,665 | A | 4/1996 | Dressel et al. | |
| 5,613,779 | A | 3/1997 | Niwa | |
| 5,630,308 | A | 5/1997 | Guckenberger | |
| 5,878,549 | A | 3/1999 | Littmann et al. | |
| 6,074,097 | A | 6/2000 | Hayashi et al. | |
| 6,224,467 | B1 | 5/2001 | Tanaka et al. | |
| 6,402,379 | B1 | 6/2002 | Albright | |
| 6,610,338 | B2 | 8/2003 | Tang | |
| 6,679,629 | B1 | 1/2004 | Benito-Navazo | |
| 6,860,843 | B2 | 3/2005 | Hayashi et al. | |
| 7,531,228 | B2 | 5/2009 | Perre et al. | |
| 7,607,834 | B2 | 10/2009 | Alvater et al. | |
| 7,757,855 | B2 | 7/2010 | Jarvis et al. | |
| 8,021,049 | B2 | 9/2011 | Smith | |
| 8,066,120 | B2 | 11/2011 | Jarvis et al. | |
| 8,251,217 | B2 | 8/2012 | Hemmerlin et al. | |
| 8,307,983 | B2 | 11/2012 | Ludwig et al. | |
| 8,616,374 | B2 * | 12/2013 | Hemmerlin | B65D 75/5844 206/440 |
| 9,145,248 | B2 * | 9/2015 | Krumme | B65D 75/5805 |
| 2003/0118254 | A1 | 6/2003 | Razeti et al. | |
| 2005/0031232 | A1 | 2/2005 | Jammet et al. | |
| 2006/0023976 | A1 | 2/2006 | Alvater et al. | |
| 2006/0177162 | A1 | 8/2006 | Harano et al. | |
| 2008/0105582 | A1 | 5/2008 | Ludwig et al. | |
| 2009/0074333 | A1 | 3/2009 | Griebel et al. | |
| 2009/0194447 | A1 * | 8/2009 | Okada | A61F 15/001 206/440 |
| 2009/0238502 | A1 | 9/2009 | Bhattacharjee et al. | |
| 2009/0241483 | A1 * | 10/2009 | Detwiler | B65D 75/5805 53/492 |
| 2010/0288770 | A1 | 11/2010 | Ackermann et al. | |
| 2010/0290720 | A1 | 11/2010 | Ichikawa et al. | |
| 2010/0326877 | A1 | 12/2010 | Hemmerlin et al. | |
| 2011/0064338 | A1 | 3/2011 | Surdziel | |
| 2011/0158564 | A1 | 6/2011 | Krumme | |
| 2011/0192754 | A1 | 8/2011 | Slominski et al. | |
| 2011/0293207 | A1 | 12/2011 | Edwards et al. | |
| 2012/0006707 | A1 | 1/2012 | Krumme | |
| 2013/0015092 | A1 * | 1/2013 | Suzuki | B65D 75/30 206/497 |
| 2013/0341237 | A1 * | 12/2013 | Krumme | B65D 75/5805 206/530 |

FOREIGN PATENT DOCUMENTS

| | | | |
|---|---|---|---|
| JP | 05147660 | A * | 6/1993 |
| JP | 2001031112 | A | 2/2001 |
| JP | 2005289407 | A * | 10/2005 |
| JP | 2006176207 | A * | 7/2006 |
| JP | 2006219140 | A * | 8/2006 |
| JP | 2008213923 | A * | 9/2008 |
| JP | 2010030651 | A * | 2/2010 |
| JP | 2011073727 | A * | 4/2011 |
| JP | 2012012103 | A * | 1/2012 |

OTHER PUBLICATIONS

Machine translation of JP 20100030651 A (Kitagawa).*
Machine translation of the description of JP 2006176207 A.*
Machine translation of the description of JP 2006219140 A.*

* cited by examiner

TEAR-OPEN POUCH FOR FRAGILE THIN MATERIALS

BACKGROUND

1. Technical Field

The present application relates generally to packaging and more specifically to pouches that tear to open.

2. Background Information

Contents such as oral thin strips and transdermal patches can be contained within a pouch to protect the contents from contamination, air, moisture, etc. For example, the pouch can be and is typically hermetically sealed. The pouch can be flat with the contents between two sheets that form the pouch. In order to obtain and use the contents, certain pouches are opened by tearing the pouch at one end such that both of the sheets are torn along a common path resulting in separating the pouch end from the remainder of the pouch. This results in having two pieces of the package having to be thrown away. If the tear is not properly directed and controlled, it can also proceed through the contents e.g. an oral strip or patch and cause damage to the product. The contents can then be obtained by separating the two sheets along the perimeter seal. However, separating the two sheets can be difficult and additional packaging area near the end tear is often needed in order to provide sufficient surface area to grab the two sheets to separate them.

These pouches often are used to contain an oral thin strip drug delivery format. However, demand for the oral thin strip drug delivery format has not grown significantly due at least partially to the difficulty of incorporating both child opening resistance and senior package opening friendliness into the pouch.

BRIEF SUMMARY

In one form of the present disclosure, a tear-open pouch includes a first panel and a second panel sealed to one another at a perimeter seal defining a perimeter of a compartment of the pouch and defining a first compartment area of the first panel and a second compartment area of the second panel. A first score is disposed on the first panel and extends from a first position in the perimeter seal along a first direction that extends across the first panel and into the first compartment area. An optional second score is disposed on the second panel and extends from a second position in the perimeter seal along a second direction that extends across the second panel and into the second compartment area of the second panel. The second position being adjacent to the first position, and the first and second directions being divergent to one another. This perimeter seal may be peelable or non-peelable.

In another form of the present disclosure, a tear-open pouch includes a first panel and a second panel sealed to one another at a perimeter seal defining a perimeter of a compartment of the pouch and defining a first compartment area of the first panel and a second compartment area of the second panel. A first score is disposed on the first panel and extends from a first position in the perimeter seal along a first direction that extends across the first panel and into the first compartment area. The first position is adjacent to a corner of the perimeter seal such that when the first score is tom, the second panel forms a tear in a second direction along an inside edge of the perimeter seal; the first and second directions being divergent to one another. This perimeter seal may be peelable or non-peelable.

In another form of the present disclosure, a tear-open package is provided which combines the tear-open pouch described in the paragraphs above with contents such as a fragile to tearing product especially one having a thickness less than 1 millimeter.

DETAILED DESCRIPTION

Described herein are pouches that provide a way to tear open the pouch to obtain the contents. In particular, the tear-open pouches described herein provide easy access to remove contents within the pouch after the pouch has been tom open. The novel pouches may be manually opened without use of scissors or other tools. In a preferred embodiment, the pouch is configured to prevent or deter accidental opening or opening by very young children while concomitantly providing a manual opening feature that is easy to use by older persons without resort to scissors, knives or other cutting implements, or tools.

Figure 1:
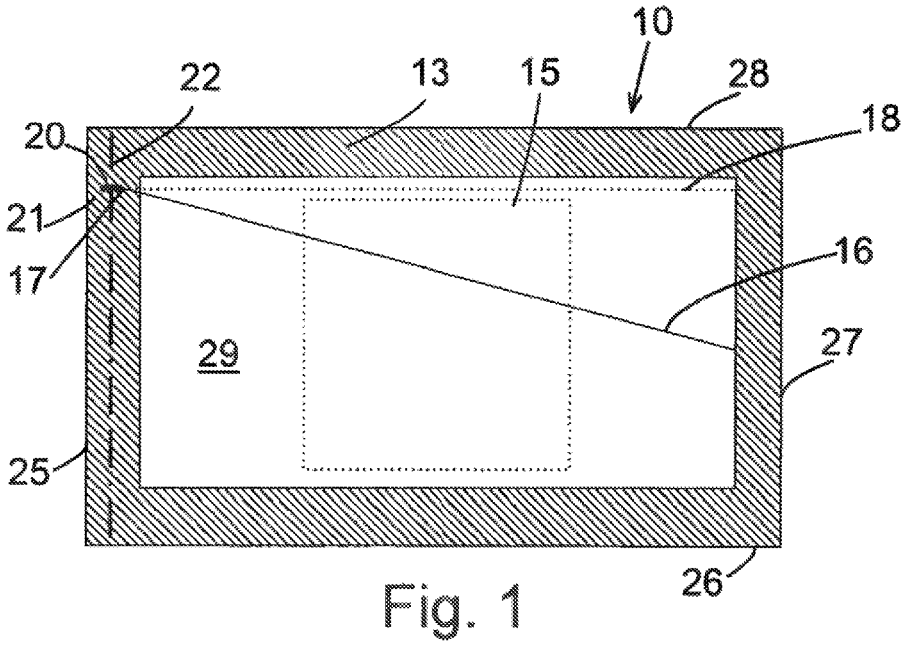
FIG. 1 is a plan view of a first side of a pouch.
Figure 2:
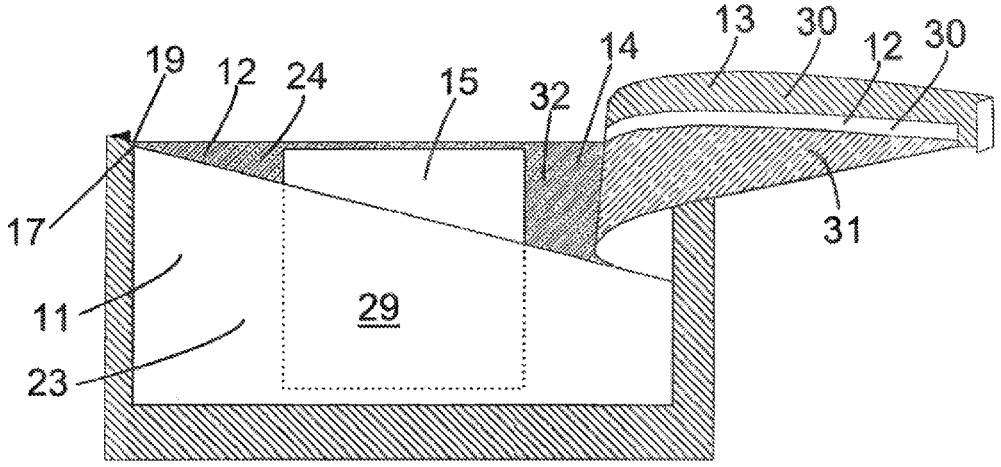
FIG. 2 is a plan view of the first side of the pouch of FIG. 1 with the pouch torn open.

FIGS. 1 and 2 illustrate a tear-open pouch 10 in an un-tom state and a torn open state, respectively. The pouch 10 has a first panel 11 and a second panel 12 sealed to one another at a perimeter seal 13 defining a perimeter of a compartment 14 of the pouch 10 and defining a first compartment area 23 of the first panel and a second compartment area 24 of the second panel. The perimeter seal 13 may be either peelable or non-peelable. Advantageously, the perimeter seal is a non-peelable seal e.g. a strong integral heat seal along the entire perimeter. Such a non-peelable seal may be easily opened by the inventive design without necessitating the added cost of providing one or more peelable film layers with special polymer selection to facilitate peelability. Alternatively, the invention permits use of a peelable seal such as a perimeter seal which is peelable along at least a portion of the seal or along the entire seal to provide optional additional access to the pouch contents or to an imprinted coupon on the interior surface of a pouch. The edges of the first and second panels 11, 12 can form the edges 25, 26, 27, 28 of the pouch 10. The respective first and second panels 11, 12 may each have outer and inner surfaces. First panel 11 has outer surface 29 and inner surface 31. Second panel 12 has outer surface 30 and inner surface 32. The perimeter seal 13 can be formed by a variety of ways, but is preferably a permanent seal. For example, the perimeter seal 13 may be formed as a weld heat seal by application of heat and pressure to the first panel 11 and the second panel 12 with their respective inner surfaces 31, 32 in contact with each other for a sufficient time to cause bonding with cooling of the bonded perimeter to form an integral permanent seal 13. Alternatively, an adhesive can be sandwiched between the inner surface 31 of first panel 11 and the inner surface 32 of second panel 12. The perimeter seal 13 can be resistant to peeling in order to resist opening by a child. For example, the perimeter seal 13 may be a permanent seal made by use of a heat seal or permanent adhesive. The perimeter seal 13 can, for example, have a width of about 1 mm to about 5 mm or more.

The perimeter seal 13 in combination with the first and second panels 11, 12 can hermetically seal contents 15 within the compartment 14. Thus, the pouch 10 can provide a barrier to oxygen, moisture, ultraviolet light, chemicals, biological agents, pathogens etc. The contents 15 can be, for example, pharmaceuticals, medical devices, oral thin strips, whitening strips, unit dose tablets, transdermal patches, vitamins, minerals, nutrients, perfumes, biologics, chemicals, cosmetics, organoleptic agents, antiseptics, labels, sensors, tea bags, paper products, films, flexible films, pullulan strips, piroxicam strips, electronic components, chemical test strips, filters, bioactive agents, adhesive products, bandages, wound care products. Furthermore, the pouch 10 may have inner surfaces 31, 32 each comprising a layer that has a low interaction with the pouch's intended contents e.g. a drug or chemical and may be substantially chemically inert and/or resist scalping of contents. The contents 15 are illustrated in FIG. 1 as a dashed line to illustrate that the contents 15 are within the pouch 10.

The first panel 11 and the second panel 12 can be made from the same materials or different materials. Furthermore, the first and second panels 11, 12 can be a multilayered or laminated structure. The structure may be a single layer or a plurality of layers which may be polymeric, metallic, sheets, films or foils or combinations thereof. For example, the first and second panels 11, 12 can have a metal foil layer that forms an internal layer inside of the first and second panels 11, 12 and one or more polymer layers that form the outside surface of the pouch 10. The metal foil layer can be aluminum. The one or more polymer layers can include cellulosic or noncellulosic polymers, homopolymers or copolymers, blends of polymers. The panels may be constructed of one or more materials which contribute specific functionality to the package. Examples of suitable materials for one or more of these layers include metal foils, metalized films, polymers or copolymers such as polyethylene terephthalate, polyolefins e.g. polyethylene, polyester, nylon, styrenic polymers, cyclic polyolefins, oxygen or moisture barrier polymers such as ethylene vinyl alcohol copolymers, polyacrylonitriles, and vinylidene chloride copolymers such as saran. For example, a polyethylene layer can be sandwiched between a polyethylene terephthalate layer and the foil layer. The pouch 10 can further have a sealant layer that forms the inside surface of the compartment 14 such that an oxygen and/or moisture and/or uv light barrier layer such as the metal foil layer can be sandwiched between the sealant layer and the one or more polymer layers. The sealant layer can include polyethylene, ionomer, polyacrylonitrile, polyester, Barex®, or Surlyn®. The laminate may include more layers than those described above such as an adhesive layer between the sealant layer and the foil layer to adhere the sealant layer to the foil layer. Advantageously, sealants such as adhesives may be pattern applied. The thickness of the multilayer structure laminate may be, for example, between about 50 μm and about 200 μm. Examples of laminates include PerfecPharm™ P510, PerfecPharm™ P512, PerfecPharm™ P618, and PerfecPharm™ P619, which are available from Perfecseal, Oshkosh, Wis.

In the example illustrated in FIGS. 1 and 2, the pouch 10 is relatively flat and forming a rectangular shape, but it will be recognized that many different shapes including polygons such as hexagons or circular or oval or other curved or linear shapes or combinations thereof may be used. The first and second panels 11, 12 can be of corresponding rectangular shapes that form first and second sides of the pouch 10. Furthermore, the rectangular shape of the pouch 10 can have length and a width where the length is greater than the width. However, the length and width can be equal or the width can be greater than the length.

To illustrate the tear-open feature of the pouch 10, FIG. 1 illustrates the pouch 10 in an un-tom state, and FIG. 2 illustrates the pouch 10 in a tom state (e.g., opened). A first score 16 is disposed on the first panel 11 and extends from a first position 17 in the perimeter seal 13 along a first direction that extends into the first compartment area 23 of panel 11 and towards pouch edge 27. Preferably this score 16 is made into the outer surface 29, but does not cut through the thickness of panel 11. Alternatively, the score may be made on the inner surface 31 or even within one or more intermediate layers. A second score 18 is disposed on the second panel 12 and extends from a second position 19 in the perimeter seal 13 along a second direction that that extends across the second panel 12. Score 18 begins at position 19 and extends from the perimeter seal area into the second compartment area 24 of panel 12 towards pouch edge 27. The second score 18 is illustrated in FIG. 1 as a dashed line to illustrate that the second score 18 is formed in the second panel 12 that is behind the first panel 11. The second position 19 can be adjacent to the first position 17, and the first and second directions can be divergent to one another. Although the first and second positions 17, 19 can be proximate to or directly neighbor one another through the first and second panels 11, 12, the first and second positions 17, 19 can be spaced some distance from one another while still allowing the first and second scores 16, 18 to be torn substantially concurrently. Therefore, the first and second positions 17, 19 being adjacent to one another includes the first and second positions 17, 19 being spaced from one another some distance while allowing the first and second scores 16, 18 being torn substantially concurrently.

To open the pouch 10, the first score 16 and the second score 18 can be manually tom from the first and second positions 17,19 in the first and second directions respectively and towards spaced apart locations in the compartment areas 23, 24 near the perimeter seal that is proximate pouch edge 27. For example, each side of the first and second positions 17, 19 of the perimeter seal 13 can be gripped and each side can be pulled in generally opposite directions that are generally parallel to the first and second directions. By having the first and second direction being divergent, the contents 15 can be exposed to allow a user to remove the contents 15 from the pouch 10. As illustrated in FIG. 2, a portion of the contents 15 is partially exposed while another portion of the contents 15 remains within the pouch 10 (illustrated as a dashed line). Thus, the contents 15 can be seen and removed without further opening the pouch 10.

Figure 3:
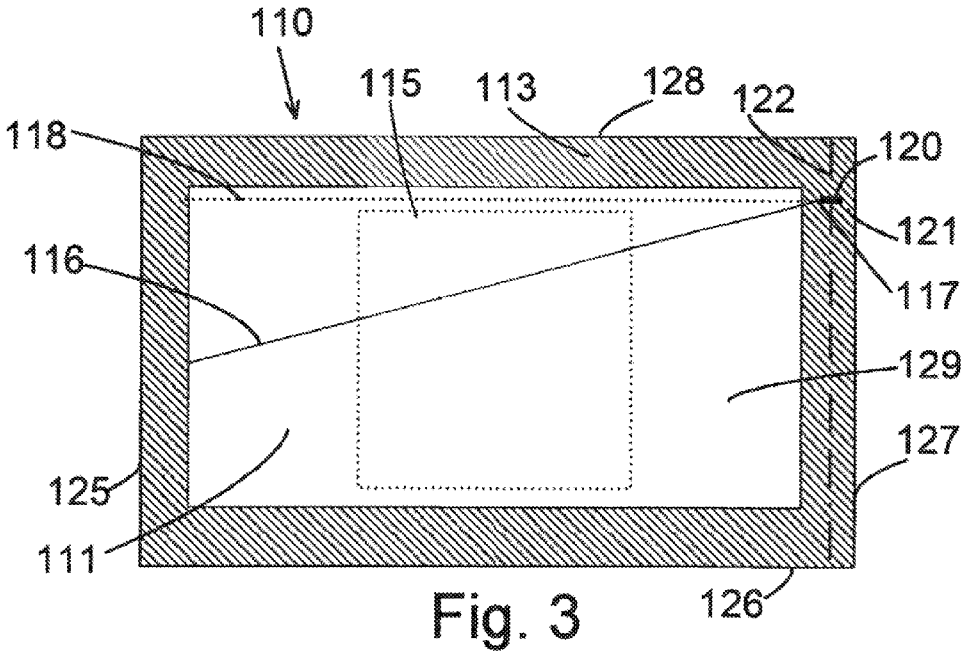
FIG. 3 is a plan view of the first side of an alternative configuration of the pouch of FIG. 1.
Figure 4:
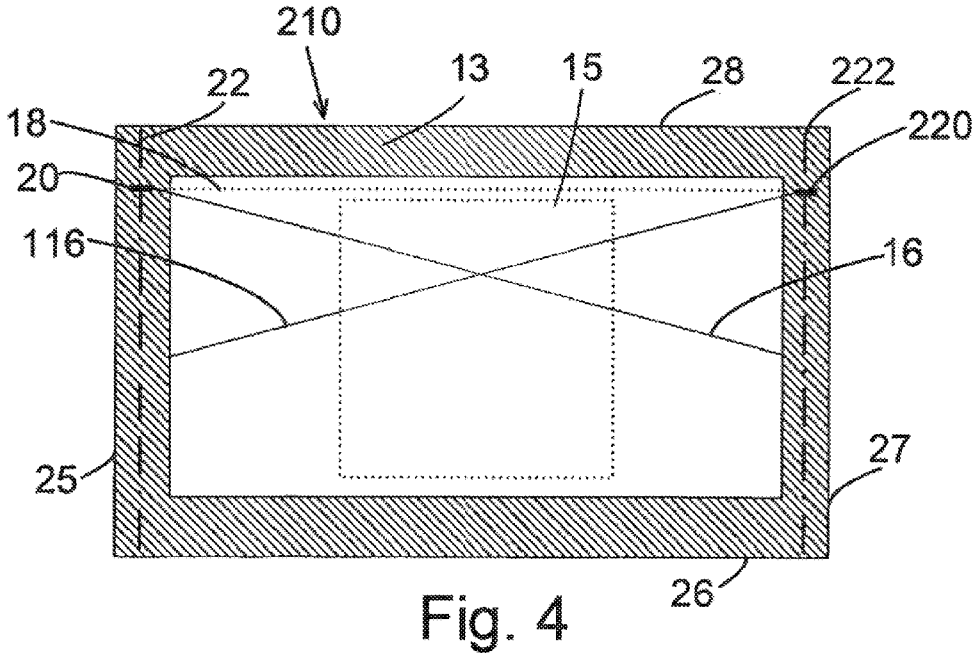
FIG. 4 is a plan view of the first side of an alternative embodiment of the pouch of FIG. 1.

Although the pouch 10 can be torn open by a user by a variety of methods, the pouch 10 illustrated in FIGS. 1 and 2 may be more easily opened by a right-handed person. With the edge 25 of the pouch 10 held horizontally as the top of the pouch with edge 27 at the bottom, the user can fold the perimeter seal 13 proximate the pouch edge 25 along fold line 22 to provide access to tearing aid notch 20 along the now folded edge. Then the user can, with one hand, hold pouch 10 in an area proximate a corner formed by intersecting edges 25, 26 while gripping with the other hand the portion of the pouch to the right of the tearing aid notch 20 adjacent positions 17, 19. The portion of the pouch 10 that will be ripped away from the contents 15 can be pulled generally toward the first panel surface 29 while the portion of the pouch 10 that will remain with the contents 15 can be held in a fixed position or pulled generally away from surface 29. Therefore, a right-handed person may be able to open the pouch 10 more easily when, relative to the user, the tear initiation point adjacent the first and second positions 17, 19 is positioned towards the right side of an edge (as shown in FIGS. 1 and 2 and described above) with the portion of the pouch 10 that will be ripped away from the contents 15 held in the right hand and the portion of the pouch 10 that will remain with the contents 15 held in the left hand. An alternative embodiment found to be convenient for left handed opening is depicted in FIG. 3. The embodiment of FIG. 3 has the same basic features of that of FIGS. 1 and 2, but with the orientation of the score line reversed. So pouch 110 is depicted with first panel 111 having edges 125, 126, 127, and 128, perimeter seal 113, contents 115, second score 118. However edge 127 is now held at the top with edge 125 at the bottom during opening and fold line 122 is now in the seal area proximate to edge 127 with initiator aid notch 120 similarly disposed in seal 113 proximate edge 127 near the corner formed with edge 128. The score line 116 is in a reversed position extending from position 117 in the perimeter seal 113 near the edge 127 across the first panel compartment area 129 towards edge 125. Non-notched section 121 may be folded back to access the tearing aid notch 120 to manually open the pouch 110. Another embodiment where a plurality of score lines are used to facilitate opening by gripping or tearing with either hand regardless of a user's natural handedness is shown in FIG. 4 which combines the score line 16 of FIG. 1 with the mirrored score line 116 of FIG. 3. So pouch 210 of FIG. 4 is essentially pouch 10 of FIGS. 1 and 2 having perimeter seal 13, contents 15, first score line 16, second score line 18, first fold line 22, first tear initiator notch 20, edges 25, 26, 27 and 28, but with addition of a second fold line 222, a second score line 116, a second tear initiator notch 220 as described with respect to FIG. 3.

Figure 5:
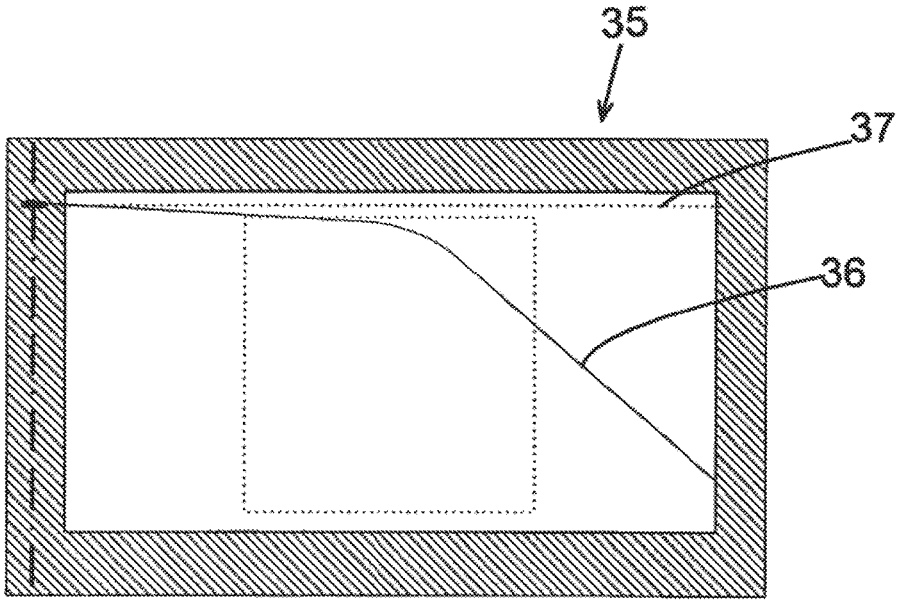
FIG. 5 is a plan view of a first side of a pouch with a score that extends arcuately.

Returning to FIGS. 1 and 2, alternative modifications may be made e.g. the first score 16 can extend diagonally such that the first direction has a vector having both a length and width component relative to the pouch 10. The first and second positions 17, 19 can be adjacent to a corner of the compartment 14 and/or the perimeter seal 13. The first and second positions 17, 19 can also be spaced from corners of the compartment 14 and/or the perimeter seal 13. For example, the first and second positions 17, 19 can be anywhere along the perimeter seal 13. The second score 18 can extend substantially parallel to an edge of the compartment 14 e.g. parallel to edge 28 as shown. Thus, for example, the second direction can have a vector that substantially only has one of either a length component or a width component relative to the pouch 10. However, the first and second scores 16, 18 can have other configurations. In particular, the first and second scores 16, 18 can be linear or straight as illustrated in FIGS. 1 and 2, or the first and second scores 16, 18 can have curvature or a combination of a linear portion with a curved portion. For example, FIG. 5 illustrates a pouch 35 that has a first score 36 that extends arcuately and the second score 37 extends straight. Thus the design FIGS. 1 and 2 may also be modified so that the first and/or second scores 16, 18 extend arcuately along a majority of the length and at least a portion of the width of the pouch 10. Furthermore, the first panel 11 can be free of a score that is aligned with and opposing the second score 18, and the second panel 12 can be free of a score that is aligned with and opposing the first score 16.

Figure 6:
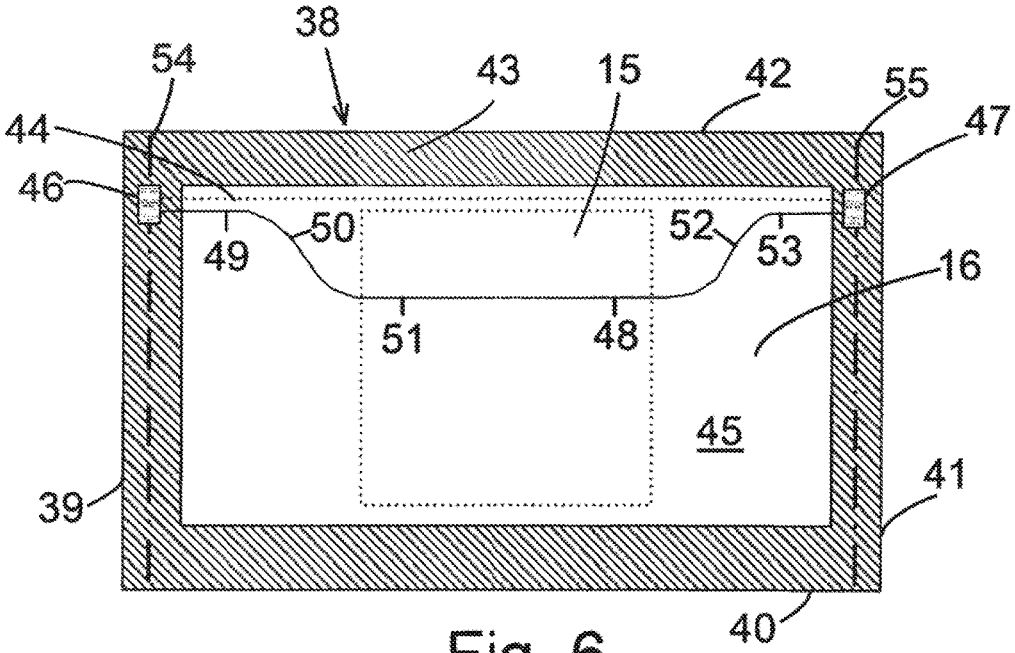
FIG. 6 is a plan view of the first side of an alternative embodiment of the pouch of FIG. 1.

As described above, the first and second directions of the first and second scores 16, 18, respectively, can be divergent. For example, at least a portion of first score 16 can be nonparallel to at least a portion of the second score 18. When the first score 16 extends arcuately, the first score 16 may be substantially parallel to the second score 18 as the first and second scores 16, 18 begin to extend from the first and second positions 17, 19, respectively. Then, the first score 16 can curve and become nonparallel to the second score 18. When the first and second scores 16, 18 are straight, an angle can be formed between the first and second scores 16, 18. For example, the angle can be at least 5 degrees, or the angle can be at least 10 degrees. Furthermore, the angle can be less than about 45 degrees, or the angle can be less than about 20 degrees. For instance, the angle can be between about 5 and about 20 degrees. When the first score 16 extends arcuately, the portions of the first and second score 16, 18 that are nonparallel may form angles such as those described with regard to when the first score 16 extends linearly. The embodiment of FIG. 6 depicts a pouch 38 having edges 39, 40, 41, and 42 with a perimeter seal 43 and a substantially straight score 44 in a rear panel with a front first panel 45 having first and second tear initiators such as respective roughened portions 46,47. Front panel score 48 extends in a first parallel portion 49 from a position proximate or at tear initiator 46 running parallel to rear second panel score 44. This first parallel portion 49 then curves downward as first curved portion 50 to a lower second parallel score portion 51 and then curves upward as second curved portion 52 to a third parallel score portion 53 which ends proximate second tear initiator 47. This embodiment is suitable for opening at either end by right or left handed persons with equal ease by various methods in which the pouch may be held and manipulated with tearing motions towards, away from or to the left, right, up or down relative to the user's perspective. Fold lines 54 and 55 provide foldable access to tearing aids 46, 47. In this embodiment, the front panel score 48 has at least one portion 49 which is parallel to rear panel score 44.

The scores of the various embodiments described herein e.g. first and second scores 16, 18 of FIGS. 1 and 2, can be formed by a number of methods such as by a laser scoring or other scoring methods. By way of example, the scores such as the first and second scores 16, 18 can be formed by removing a portion of the first and second panels 11, 12, respectively, to form a groove or notch in the outer surface of the first and second panels 11, 12. The first and second scores 16, 18 can extend partially into the panels 11, 12 but do not extend entirely through the thickness of the panels 11, 12. For example, the scores 16, 18 can extend at least partially through the one or more polymer layers of the panels 11, 12 such as an outer layer, but not extend through the metal foil layer. In another example, the scores 16, 18 extend substantially the entire thickness of or extend completely through the one or more polymer layers of the panels 11, 12.

The scores 16, 18 can extend from the first and second positions 17, 19 to a location inside or outside the perimeter seal 13 on an opposite side of the pouch 10 as that of the first and second positions 17, 19. The scores 16, 18 can extend the majority of the length from the side with the first and second positions 17, 19 to the opposite side. For example, the scores 16, 18 can extend at least 50% of the length or at least 80% of the length. The scores 16, 18 may not extend the entire length of the pouch 10, which can result in the peeled portion of the pouch 10 not detaching from the rest of the pouch 10. By not detaching a piece of the pouch 10, a single piece of packaging can be thrown away. In order for the scores 16, 18 to not extend the entire length of the pouch 10, the scores 16, 18 can terminate prior to or inside an edge of the pouch 10. For example, the scores 16, 18 can terminate within the perimeter seal 13 or within the panel compartment areas 23, 24.

The pouch 10 can further include a tearing aid or tear initiator such as a notch 20 at the first position 17 and the second position 19 that extends through the thickness of the first and second panels 11, 12. The tearing aid/notch 20 can be on an outside edge of the pouch 10 or, as illustrated in FIGS. 1 and 2, can be spaced a distance from the outside edge such that a non-notched section 21 of first and second panels 11, 12 adjacent to the outside edge does not have the notch 20. When the tearing aid/initiator/notch 20 (hereinafter notch, by example) is spaced from the outside edge of the pouch 10, the pouch 10 can resist tearing unless the pouch 10 is folded along the notch 20 such as along the dotted line 22 illustrated in FIG. 1. After the pouch is folded, the notch 20 is exposed and the notch 20 can be used to tear the pouch 10. FIG. 2 illustrates that the pouch 10 has been folded along the dotted line 22 and tom with the tear starting at the notch 20. By having to fold along the notch 20 before tearing, the pouch 10 can resist being opened by a child since a child would not intuitively recognize that the pouch 10 would need to be folded to be able to tear the pouch 10 open. An indicator such as dotted line 22 can be printed on the pouch 10 to indicate how the pouch 10 is to be folded to be tom. However, the other indicators such as instructions can be printed on the pouch 10 or no indicator can be included.

Examples of tearing aids or tear initiators such as notches, slits, perforations, surface roughened portions, etc., are described in U.S. Pat. Nos. 4,778,058; 3,608,815; 4,834,245; 4,903,841; 5,613,779; 5,988,489; 6,102,571; 6,106,448; 6,541,086; 7,470,062; and 7,481,581, the teachings of each of which is hereby incorporated by reference in its entirety. Such tear initiators may be used on one or more edges of the inventive pouch and package or may be set apart from the edge and used in conjunction with folding to provide access to the tear initiator to impart a child opening resistance feature. Typically, the tear initiator is located within ½ inch of a pouch edge and preferably between about ¼ to ½ inch from the edge. Advantageously, this location minimizes the chances that the package will be opened in a manner contrary to that intended and assists in protecting any enclosed product from tearing during opening without adding unnecessary material cost to the package.

The one or more polymer layers of the pouch 10 can also be configured to have an orientation of the polymer chains to either make tearing the pouch easier or more difficult. For example, the polymer chains can be generally orientated in a direction parallel to the first and/or second scores 16, 18 to make tearing along the first and/or second scores 16, 18 require less force than if the polymer chain orientation was not aligned. Furthermore, the polymer chains can be generally oriented in a direction perpendicular to the first and/or second scores 16, 18 to make tearing along the first and/or second scores 16, 18 require more force than if the polymer chain orientation was not aligned. The one or more polymer layers can also be biaxially oriented. For example, the outer layer of the pouch 10 can be oriented polyethylene terephthalate or biaxially oriented polyethylene terephthalate.

The first and second scores 16, 18 can be formed into the first and second panels 11, 12, respectively, prior to forming the pouch 10. As described above, the first and second panels 11, 12 can include a plurality of layers. These panels may be provided as film sheets or rolls having a web sheet thickness of from 1 mil or less in thickness to 10 mil or more. A multilayer film sheet can be formed by coextrusion, coating lamination, adhesive lamination or by any of the known processes for making multilayer film sheet structures which form, join or otherwise laminate a plurality of layers together. The multilayer sheet then can be used to form the panels of pouches. However, the scores can be formed onto the multilayer sheet or individual layer components thereof prior to forming of the pouch. After scores are formed on the sheet, a first sheet that will form first panels can be aligned with a second sheet that will form second panels. Existing equipment for aligning the first and second sheets can be used to align printed labels on pouches. After the first and second sheets are aligned, perimeter seals can be formed into the first and second sheets and the pouches can be cut from the first and second sheets thereby forming a plurality of pouches from the aligned first and second sheets. Each of the sheets can be formed from web roll which can be unrolled to provide sheet portions which are then sealed and cut into pouches. Furthermore, rolls may be wider than the dimensions of the pouches to be made so that a plurality of pouches can be formed along a width of the roll. After the pouch is formed, a notch, as described above, can optionally be formed into the pouch.

Figure 7:
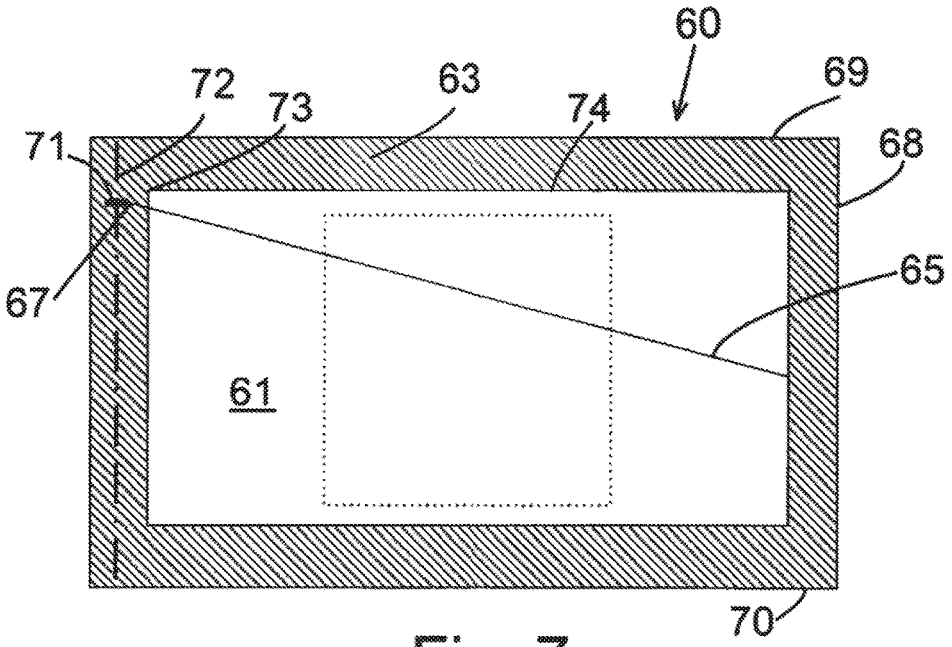
FIG. 7 is a plan view a first side of pouch without a score on a second side.
Figure 8:
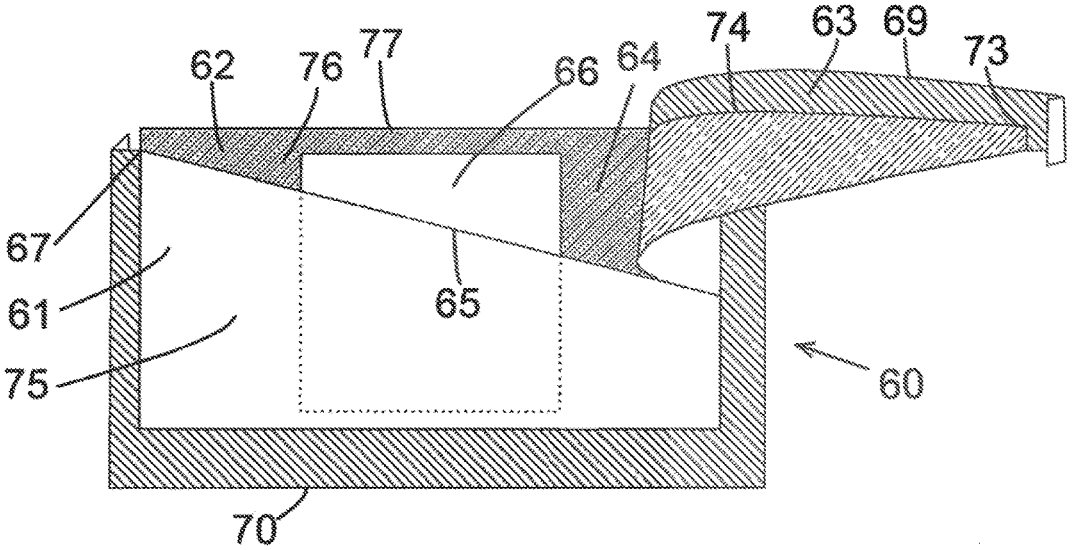
FIG. 8 is a plan view of the first side of the pouch of FIG. 7 with the pouch torn open.

FIGS. 7 and 8 illustrate another example of a pouch 60 similar to the pouch 10 illustrated in FIGS. 1 and 2. However, the pouch 60 of FIGS. 7 and 8 does not have a second score on the second panel 62. For example, the second panel 62 can be free of a score. The first panel 61 and the second panel 62 are sealed to one another at a, e.g. non-peelable, perimeter seal 63 defining a perimeter of a compartment 64 of the pouch 60 and defining a first compartment area 75 of the first panel 61 and a second compartment area 76 of the second panel 62. A first score 65 is disposed on the first panel 61 and extends from a first position 67 in the non-peelable perimeter seal 63 along a first direction that extends across the first panel 61 and into the first panel compartment area 75. The first position 67 can be adjacent to a corner 73 of the perimeter seal 63 such that when the first score 65 is tom, the second panel 62 forms a tear 77 in a second direction along an inside edge 74 of the perimeter seal 63. The first and second directions can be divergent to one another. The first panel 61 can also be free of a score that is aligned with and opposing the inside edge 74, and the second panel 62 can be free of a score that is aligned with and opposing the first score 65. Although the first position 67 can directly neighbor the corner 73 through the first panel 61, the first position 67 can be spaced from the corner 73, as illustrated in FIGS. 7 and 8, while still allowing the first score 65 and perimeter seal edge 74 to be tom substantially concurrently. The pouch 60 can be tom as described with regarding to the pouch 10 of FIGS. 1 and 2.

After the pouch 60 is torn open, the contents 66 can be obtained. In another variation, a second score line may be provided on first panel 61 on either the outer or inner surface and extending from a location proximate corner 73 and notch 71 to the opposing pouch edge 68 and extending parallel to upper and lower pouch edges 69, 70. This embodiment may also be made with peelable seals.

The pouch 60 of FIGS. 7 and 8 can include one or more of the features described with regard to the pouch 10 of FIGS. 1 and 2 and the pouch 35 of FIG. 5. For example, the pouch 60 of FIGS. 7 and 8 can include a notch 71 and can be folded along the dotted line 72 similar to that of the pouch 10 of FIGS. 1 and 2. In further examples, the first score 65 can extend along a majority of a length of the pouch 60 and/or the first score can extend linearly or arcuately. These examples are not exhaustive and other features and properties of the other pouches illustrated herein in the other Figures can be applied to the pouch 60 of FIGS. 7 and 8.

Figure 9:
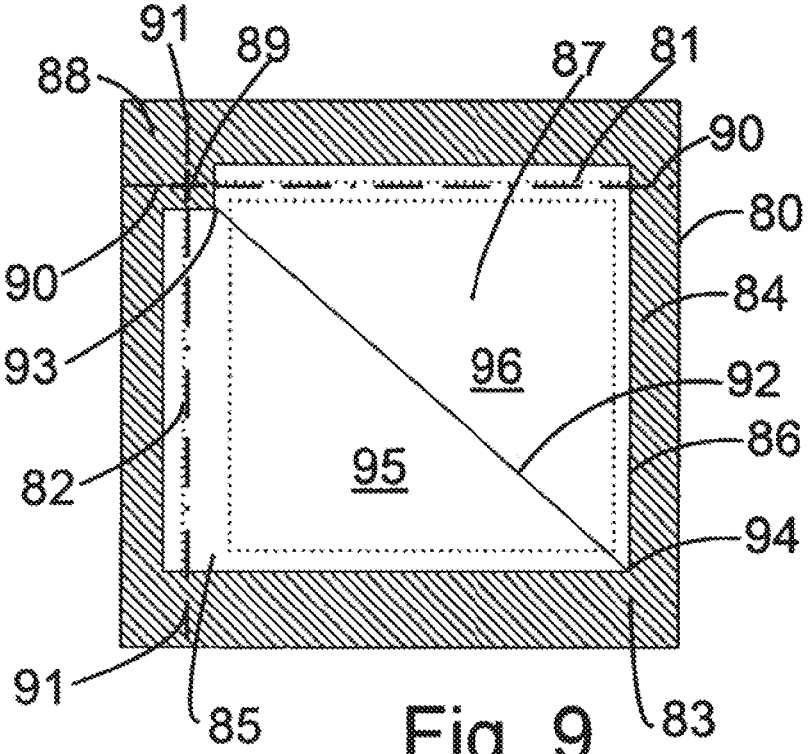
FIG. 9 is a plan view of an alternative embodiment of the invention.

Other embodiments and features incorporated into the present invention are illustrated in FIGS. 9-12. FIG. 9 depicts a package 80 with a back polymeric film panel (not shown) having a horizontal back panel score line 81 and vertical back panel score line 82. The back panel is aligned to and heat sealed to a similarly dimensioned front polymeric film panel 83 with a perimeter heat seal 84 to form a compartment 85 defined by seal inner perimeter edge 86. Compartment 85 encloses a product 87 that is fragile to tearing.

The present invention in its various embodiments finds particular utility in providing packaging for a product made of a material that is fragile in the sense that the product is susceptible to damage if both the front and back panels of the containing pouch are tom in a manner that directs a tearing force across the material body. Often these fragile to tearing (or fragile to damage) products have a thickness less than ~1 millimeter e.g. transdermal patches will generally have a thickness less than about 0.75 mm and dissolvable strips will be less than 0.5 mm.

Examples of fragile to tearing products include thin films, flexible films, dissolvable strips made e.g. of film formers such as pullulan or piroxicam, teeth whitening strips, drug delivery strips, smart labels, adhesive labels, paper products, thin plastic film products, thin brittle electronic components, flexible films printed with electronic circuits, breath strips, transdermal patch films, tea bags, sterile bandages, adhesive tapes, cosmetic strips, pore strips, antiseptic strips, chemical or biological test strips, oral strips for administering agents by mouth, inoculating devices, etc.

Referring again to FIG. 9, at least one corner of the pouch has been provided with an enlarged seal area 88 with a corner of which that extends into what would otherwise be a rectangular compartment shape of compartment 85. Within the inset portion of this seal area 88 is a tear initiator 89 as shown by a "+" cut into the film seal area. There are also depicted respective horizontal and vertical fold lines 90 and 91 which extend in perpendicular directions to one another. The front panel 83 is also provided with a front panel score line 92 which extends from a point 93 proximate an inset corner of seal area 88 diagonally across the front panel to an opposing intersection of seal inner perimeter edge 86 at inner corner point 94. The depicted embodiment permits left and right handed opening using a combination of the front score line 92 with either (a) horizontal rear panel score line 81 or (b) rear panel vertical score line 82. Thus, a user may open the package by making a fold along line 90 and tearing downward from tear initiator 89 causing a tear line to propagate simultaneously along rear vertical score line 82 and diagonal front score line 92 opening a lower portion 95 of the compartment 85 to provide access to product 87 without subjecting the product to a tearing force since the product remains supported by the back panel film along its entire area. In this manner the first and second score lines are adapted to tear open to provide lower access to the product. Alternatively, the same package 80 may be opened by folding along vertical line 91 to provide access to the same tear initiator, but now with a left to right tearing motion, the rear panel tear propagates along horizontal rear score line 81 while simultaneously causing a tear line to propagate along diagonal front score line 92 from seal area point 93 to opposing inner corner point 94 opening an upper portion 96 of compartment 85 to provide access to product 87 without subjecting the product to a tearing force since the product remains supported by the back panel film along its entire area.

Figure 10:
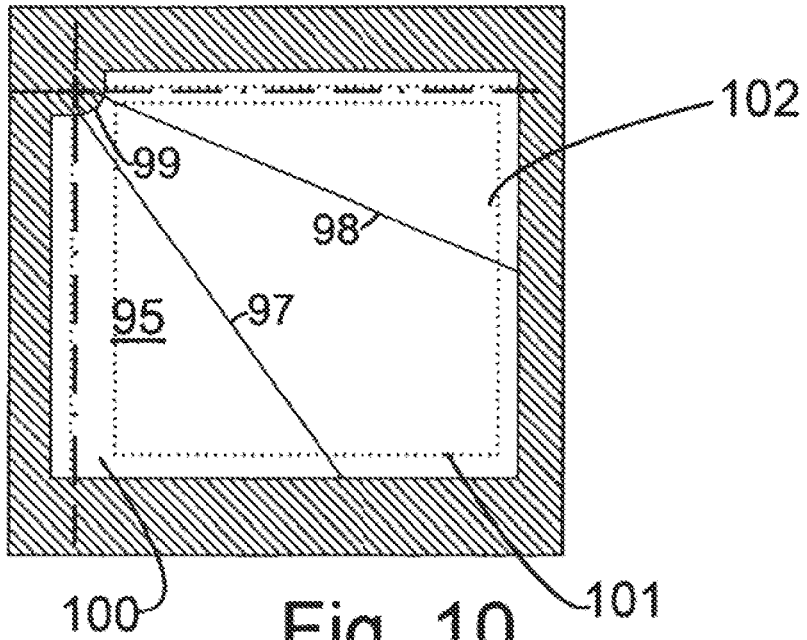
FIG. 10 is a plan view of an alternative embodiment of the pouch of FIG. 9.

Referring now to FIG. 10 a variation of the embodiment of FIG. 9 is shown with all elements and operation remaining the same except that two front score lines 97 and 98 replace the single score line of FIG. 9 and these front score lines radiate from points proximate the "+" seal tear initiator ends as for the provided rear score lines and the heat seal area containing the tear initiator curves along its intersection 99 with the package compartment. The front score lines 97 and 98 divide the front panel compartment area into three portions 100, 101 and 102. When the package is opened either portion 100 or portion 102 is pulled away from the package (as for the opening of the lower or upper portions 95, 96 of the package of FIG. 9) and in both manners of opening the central portion 101 will remain connected to the perimeter seal and with the remaining panel portion.

Figure 11:
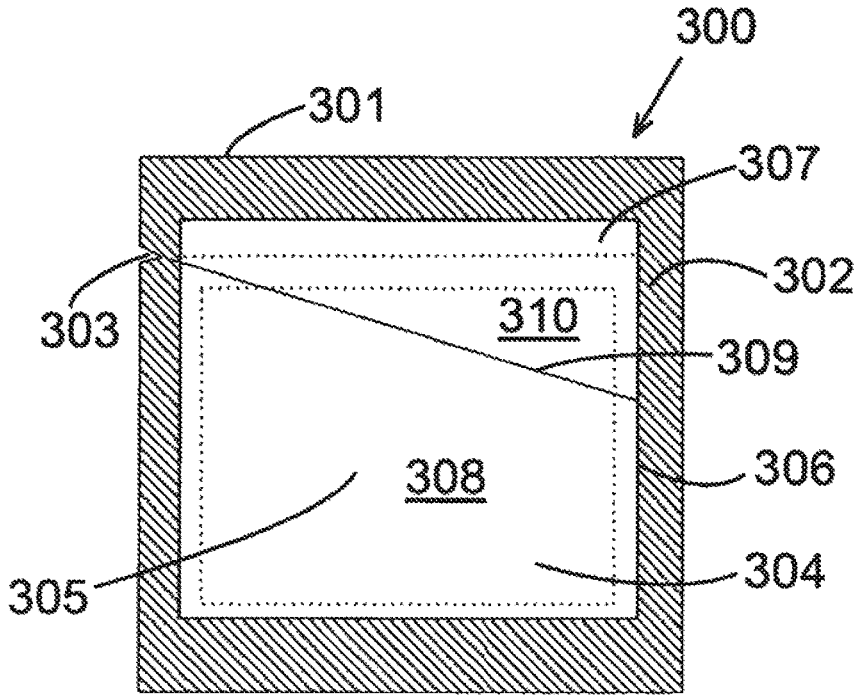
FIG. 11 is a plan view of an alternative embodiment of the invention showing a side tear notch.

Referring now to FIG. 11, a package 300 is shown having a pouch 301 with perimeter seal 302 and tear notch 303. Package 300 has a product 304 contained therein in a compartment 305 defined by a continuous inner edge 306 of perimeter seal 302. Pouch 301 is formed with mating front and rear panels that are sealed together about their perimeters by seal 302. The rear panel has a score line 307 and front panel 308 has a diagonal score line 309. This figure shows a side edge tear notch 303 which is used to tear open the pouch by simultaneously tearing along rear score line 307 and front score line 309 to pull open upper panel section 310 to provide access to the pouch contents. The pouch may be made of a peelable film to permit complete separation of the front panel from the rear panel after opening.

Figure 12:
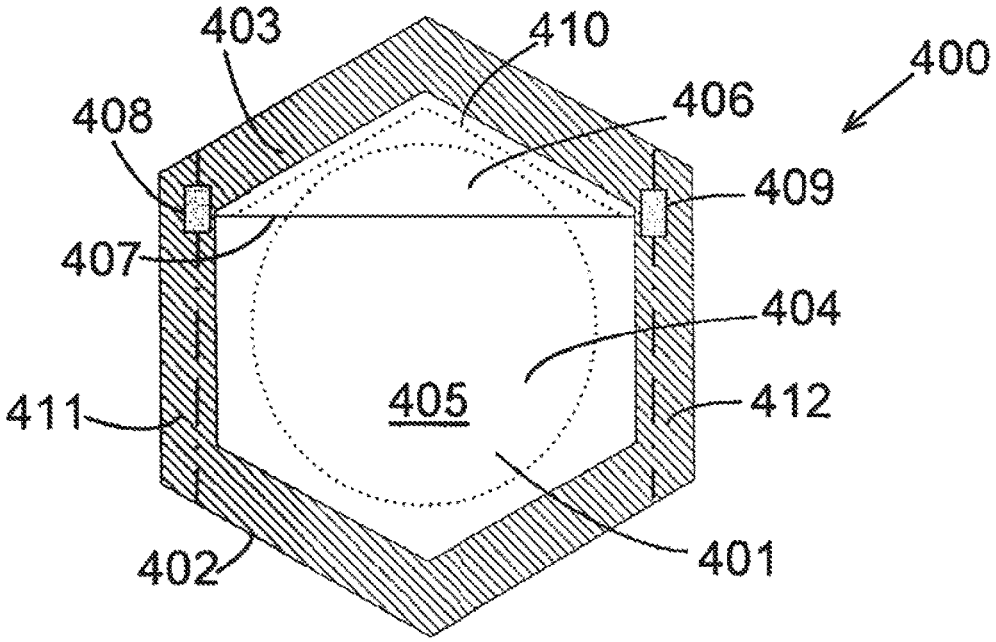
FIG. 12 is a plan view of an alternative embodiment of the invention depicting a polygonal pouch.

Referring now to FIG. 12, a package 400 comprising a circular drug delivery transdermal patch 401 enclosed by a polygonal pouch 402 is shown. Pouch 402 has a perimeter seal 403 defining a compartment 404 having a lower front panel portion 405 and upper front panel portion 406 separated by front panel score line 407. Child resistant tear initiators are provided by surface roughened portions 408, 409 proximate respective ends of score line 407. Pouch 402 is made by attaching a front flexible film panel to a mating rear flexible film panel and sealing the two panels together by perimeter seal 403. The rear panel has a score line 410 which follows and is parallel to an inner edge of the polygonal heat seal along two contiguous portions thereof extending from a locus proximate a first tear initiator 408 and ending proximate a second tear initiator 409. It is seen that the score lines diverge along at least a portion of their respective lengths.

With respect to the present invention to say that the scores diverge means that the score (or score line) in the front panel and the score (or score line) in the rear panel extend for at least a ¼ inch, preferably at least ½ inch or more in non-parallel directions. In some preferred embodiments of the invention the score lines (and in some embodiments score line equivalents such as a rear perimeter seal edge) diverge more than 25% or more than 50% or more than 90% or for 100% along their entire length.

Referring again to FIG. 12, guides to opening such as fold lines 411, 412 may be printed on the pouch 402 to indicate that the pouch 402 should be folded thereon to provide access to the child resistant tear initiator whereupon the pouch 402 may be gripped along the adjacent perimeter seal edge on either side of one of the tear initiators and pulled to separate the upper panel 406 from lower panel portion 405 thereby permitting access to patch 401 which remains supported by the rear panel.

The features of these embodiments illustrate that a variety of shapes, sizes and configurations may be employed in the present invention using non-peel able or peelable polymeric films with or without metal foil layers or tear initiators. The tear initiators may be notches or other means and located at the pouch edge or edges or set apart there from with an additional folding step required for opening to impart child opening resistance.

Advantageously, the present invention permits smaller sized packages to be used at a material cost savings while maintaining and enhancing protection of enclosed products from damage and tearing during opening operations.

Various embodiments have been described above. Although the invention has been described with reference to these specific embodiments, the descriptions are intended to be illustrative and are not intended to be limiting. Various modifications and applications may occur to those skilled in the art without departing from the true spirit and scope of the invention as defined in the appended claims.

The invention claimed is:

1. A tear-open pouch comprising a first panel and a second panel sealed to one another at a perimeter seal defining a perimeter of a compartment of a pouch and defining a first compartment area of the first panel and a second compartment area of the second panel; and a first score disposed on the first panel and extending from a first position in the perimeter seal along a first direction that extends across the first panel and into the first compartment area of that panel; and a tearing aid disposed in the perimeter seal extending through the thicknesses of the first and second panels, the tearing aid comprising a notch having a first end and a second end opposite the first end, the first end and the second end being spaced from outer edges of the pouch, wherein the first score extends from the tearing aid;

wherein the second panel is free of a score; and wherein the first position is adjacent to a corner of the perimeter seal such that when the first score is torn, the second panel contains at least one layer of oriented polymer and forms a tear in a second direction along an inside edge of the perimeter seal, and the first and second directions being divergent to one another.

2. The tear-open pouch of claim 1, wherein the first panel is free of a score that is aligned with and opposing the inside edge, and the second panel is free of a score that is aligned with and opposing the first score.

3. The tear-open pouch of claim 1, wherein the first score extends along a majority of a length of the pouch.

4. The tear-open pouch of claim 1, wherein the first score extends linearly.

5. The tear-open pouch of claim 1, wherein the first score extends arcuately.

6. The tear-open pouch of claim 1, wherein the perimeter seal is non-peelable.

7. The tear-open pouch of claim 1, wherein the perimeter seal is peelable.

* * * * *